US008206128B2

(12) United States Patent
Onoda

(10) Patent No.: US 8,206,128 B2
(45) Date of Patent: Jun. 26, 2012

(54) REFRIGERATION CYCLE SYSTEM

(75) Inventor: Izumi Onoda, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 274 days.

(21) Appl. No.: 10/580,866

(22) PCT Filed: Dec. 2, 2004

(86) PCT No.: PCT/JP2004/018320

§ 371 (c)(1),
(2), (4) Date: Feb. 27, 2007

(87) PCT Pub. No.: WO2005/061901

PCT Pub. Date: Jul. 7, 2005

(65) Prior Publication Data

US 2007/0154329 A1 Jul. 5, 2007

(30) Foreign Application Priority Data

Dec. 3, 2003 (JP) ..... 2003-405056

(51) Int. Cl.
*F04B 49/00* (2006.01)

(52) U.S. Cl. ..... 417/216

(58) Field of Classification Search ..... 417/216, 417/902, 410.3; 62/176.3, 469; 418/23–27, 418/228–232, 267

See application file for complete search history.

(56) References Cited

U.S. PATENT DOCUMENTS 4,137,726 A * 2/1979 Watada ..... 62/196.3
4,344,297 A * 8/1982 Ueno et al. ..... 62/196.3
4,558,993 A * 12/1985 Hori et al. ..... 417/283
4,780,067 A * 10/1988 Suzuki et al. ..... 417/441
5,013,217 A * 5/1991 Hitosugi ..... 417/26
5,170,636 A * 12/1992 Hitosugi ..... 62/175
6,206,652 B1 * 3/2001 Caillat ..... 417/298
6,446,456 B2 * 9/2002 Ryu ..... 62/324.6

(Continued)

FOREIGN PATENT DOCUMENTS

JP S47-019941 11/1972

(Continued)

OTHER PUBLICATIONS

PCT International Preliminary Report on Patentability dated Jul. 27, 2006 in connection with the related PCT Patent Application No. JP2004/018320.

(Continued)

*Primary Examiner* — Devon C Kramer
*Assistant Examiner* — Amene Bayou
(74) *Attorney, Agent, or Firm* — DLA Piper LLP (US)

(57) ABSTRACT

A refrigeration cycle system is provided with a two-cylinder type rotary compressor having one compression mechanism which includes a switching mechanism for switching a back surface side of a blade between a low pressure mode and a high pressure mode and controlling the inner space of the cylinder chamber to the high pressure upon switching at the low pressure mode. In a high load state, a normal operation is performed by switching the pressure of the back surface side of the blade of the one compression mechanism at the high pressure mode. In a low load state, an uncompressed operation is performed by switching the pressure of the back surface side of the blade of the one compression mechanism at the low pressure mode and by controlling the inner space of the cylinder chamber to the high pressure to move the blade away from the roller.

12 Claims, 6 Drawing Sheets

U.S. PATENT DOCUMENTS

| | | | | |
|---|---|---|---|---|
| 6,716,007 | B2 * | 4/2004 | Kim et al. | 418/23 |
| 7,293,966 | B2 * | 11/2007 | Cho et al. | 417/410.3 |
| 2003/0068236 | A1 * | 4/2003 | Tadano et al. | 417/312 |

FOREIGN PATENT DOCUMENTS

| | | |
|---|---|---|
| JP | 58-77183 | 5/1983 |
| JP | 01-247786 | 10/1989 |
| JP | H01-144492 | 10/1989 |
| JP | H02-091494 | 3/1990 |
| JP | H05-256286 | 10/1993 |
| JP | 11-166490 | 6/1999 |

OTHER PUBLICATIONS

Japanese Office Action mailed on Oct. 14, 2009, pertaining to the related Japanese patent application No. 2005-516457. (Japanese language only.).

Office Action dated Jan. 17, 2012 issued in the corresponding JP application 2009-283216.

* cited by examiner

REFRIGERATION CYCLE SYSTEM

TECHNICAL FIELD

The present invention relates to a refrigeration cycle system equipped with a two-cylinder rotary compressor, and more particularly, to a refrigeration cycle system structured to perform an uncompressed operation of one of compression sections in a low load state for realizing the low performance operation.

BACKGROUND ART

Generally, a two-cylinder rotary compressor is structured to perform the uncompressed operation of one of compression mechanisms in the low load state for the low performance operation so as to improve the operation efficiency.

Japanese Patent Application Laid-open Publication No. HEI 1-247786 (Patent Publication 1) discloses a system structured to set the pressure within a cylinder chamber at a high level, and the pressure within a back-pressure chamber on a back surface of a blade at a intermediate level, and to move the blade away from a roller by a pressure difference between the high pressure and the intermediate pressure for performing the uncompressed operation.

Japanese Patent Application Laid-open Publication No. HEI 6-58280 (Patent Publication 2) discloses the system provided with the discharge pressure chamber at one side of the blade, which is structured to reduce the pressure within the back-pressure chamber on the back surface of the blade at the low level such that the blade is pressed against the counter discharge pressure chamber under the high pressure of the discharge pressure chamber, and the blade is moved away from the roller by the pressure difference between the low pressure of the back-pressure chamber and the pressure of the cylinder chamber under compression for performing the uncompressed operation.

However, in the Patent Publication 1, as the pressure difference between the cylinder chamber and the back-pressure chamber on the back surface of the blade is small during the uncompressed operation, it is necessary to make small the spring constant of the spring member for urging the blade against the roller during the normal operation so as to move the blade away from the roller during the uncompressed operation. In the aforementioned case, the blade may jump (momentarily moving away from the roller) during the normal operation, resulting in the causing of noise or damage to the blade. In the system disclosed in Patent Publication 2, the high pressure within the discharge pressure chamber gradually leaks to the back-pressure chamber during the uncompressed operation, and the pressure within the cylinder chamber becomes gradually low. As a result, the blade cannot be held retracted, thus failing to continue the uncompressed operation.

DISCLOSURE OF THE INVENTION

It is an object of the invention to provide a refrigeration cycle system capable of continuing the uncompressed operation while preventing noise and damage from causing to the blade.

According to the first aspect of the present invention, this object can be achieved by providing a refrigeration cycle system provided with a rotary compressor including a sealed case, an electric motor disposed in the sealed case and a compression mechanism disposed in the sealed case and connected to the electric motor, wherein the compression mechanism is provided with a first compression section and a second compression section, each including a first cylinder and a second cylinder having cylinder chambers in which rollers are held to be eccentrically rotatable, respectively, and also provided with blades provided in the first and the second cylinders each having a leading end urged by a spring member so as to abut against a curved surface of the roller and serving to separate the cylinder chamber into two sections along a rotating direction of the roller, one of the first and the second compression sections is provided with a capacity regulating mechanism including a switching member which switches a back surface side of the blade between a low pressure mode and a high pressure mode and serves to control an inner space of the cylinder chamber to the high pressure upon switching of the back surface side of the blade at the low pressure mode, and a normal operation is performed in a high load state by switching the back surface side of the blade in the one of the first and the second compression sections at the high pressure mode, and an uncompressed operation is performed in a low load state by switching the back surface side of the blade at the low pressure mode and controlling the inner space of the cylinder chamber to the high pressure to move the blade away from the roller.

In a preferred embodiment of the above aspect, the one compression section provided with the capacity regulating mechanism may include a back-pressure chamber at the back surface side of the blade, which is opened and closed by a valve body, the valve body is closed to seal the back-pressure chamber upon introduction of the low pressure into the back-pressure chamber through a pressure introduction hole communicated with the back-pressure chamber and formed for introducing the low pressure, and the valve body is opened upon introduction of the high pressure to establish communication between the back-pressure chamber and the inner space of the sealed case.

Furthermore, the refrigeration cycle system of the above aspect may further include a capacity variable four-way switching valve provided with a high pressure port connected to a high pressure side of a refrigeration cycle, a low pressure port connected to a low pressure side of the refrigeration cycle, a first guide port connected to the back surface side of the blade in the one compression mechanism, and a second guide port connected to a cylinder chamber of the one compression mechanism, wherein during the normal operation, communications are established between the high pressure port and the first guide port and between the low pressure port and the second guide port, and during the uncompressed operation, communications are established between the high pressure port and the second guide port and between the low pressure port and the first guide port.

The electric motor may comprise a single-phase motor driven at a frequency of a commercial power source so as to serve to switch a capacity of a capacitor to be operated between the normal operation and the uncompressed operation.

According to the refrigeration cycle system of the characters mentioned above, there is equipped with a capacity regulating mechanism that allows the slider of a pressure regulating four-way valve, thus making it possible to vary the capacity of the compressor.

The location of such capacity variable mechanism causes no deterioration in the system performance. In addition, since the spring constant of the spring does not have to be reduced, the blade pressed by the spring at the high pressure during the normal operation is prevented from jumping, resulting in no generation of noise or damage to the blade. Furthermore, during the capacity regulated operation, a large difference in the pressure between the leading end and the back surface of the blade serves to maintain the blade within the cylinder blade groove, thus preventing abnormal noise owing to the jumping of the blade from causing. The capacity regulating mechanism may be operated during the system operation, resulting in improved comfort and energy saving effects. In the system, since the high pressure refrigerant in the sealed case does not leak to the suction side, the capacity regulating mechanism is capable of reducing the leakage loss to zero. This makes it possible to continue the uncompressed operation.

BEST MODE FOR CARRYING OUT THE INVENTION

An embodiment of a refrigeration cycle system according to the present invention will be described hereunder with reference to the drawings.

Figure 1:
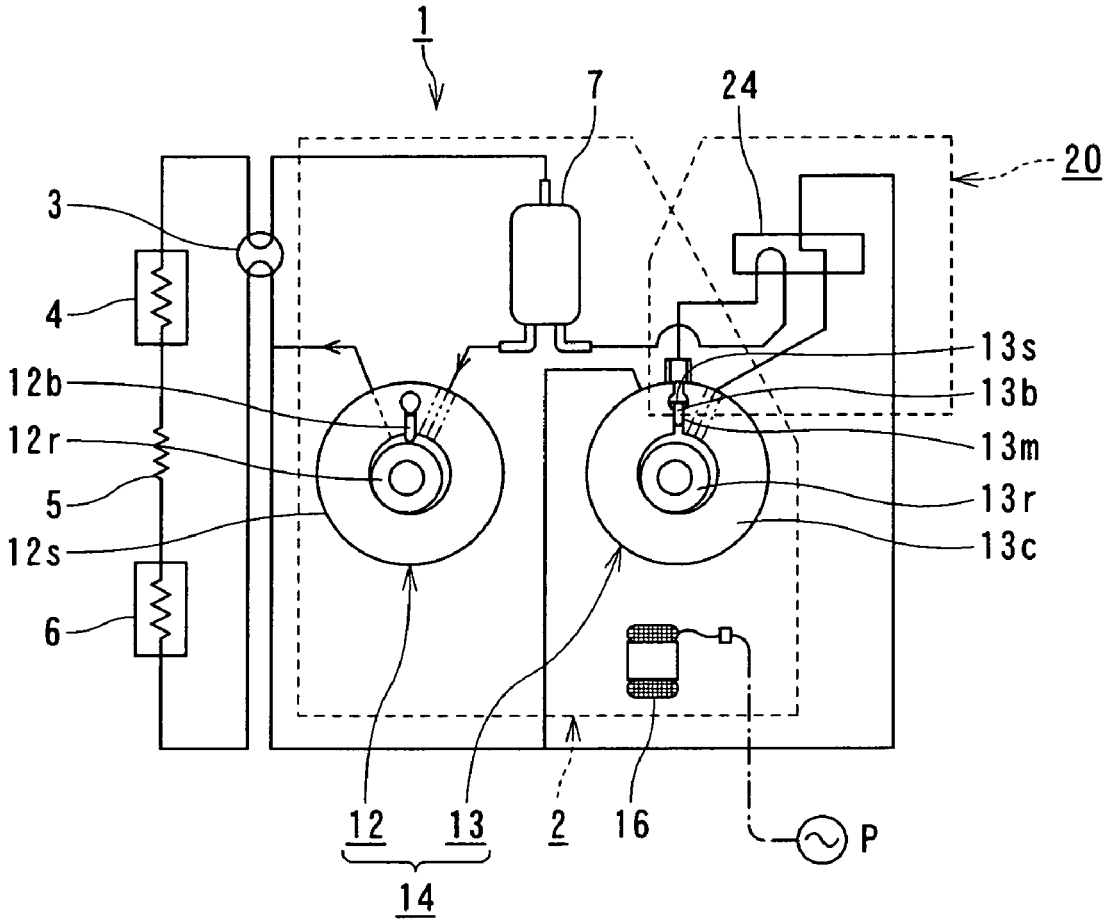
FIG. 1 is a view schematically showing a refrigeration cycle system according to the present invention.
Figure 2:
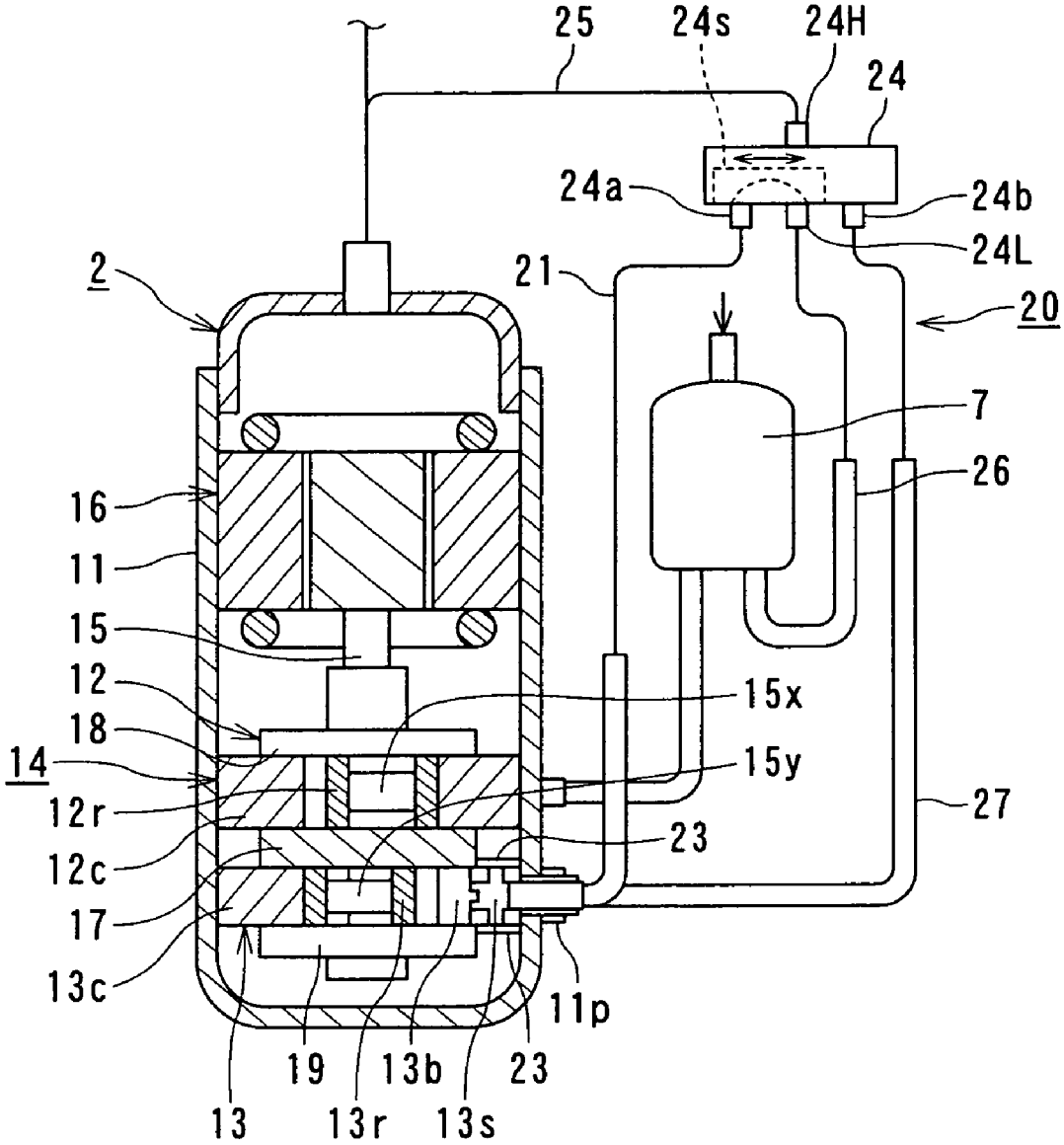
FIG. 2 is a vertical sectional view showing a two-way cylinder rotary compressor operated at a rear portion of a compression mechanism of the refrigeration cycle system of the present invention.

FIG. 1 is a conceptual view of the refrigeration cycle system according to the present invention. FIG. 2 is a vertical sectional view of a two-way cylinder rotor compressor employed for the refrigeration cycle system.

Referring to FIGS. 1 and 2, a refrigeration cycle system 1 is structured by connecting a vertical type two-way cylinder rotor compressor 2, a four-way valve 3 for switching between cooling and heating operations, an inner heat exchanger 4, a capillary tube 5 as an expander, an outer heat exchanger 6, and an accumulator 7 sequentially.

The compressor 2 includes a high pressure sealed case 11, a compression mechanism 14 composed of a first compression section 12 and a second compression section 13 stored in the sealed case 11, and an electric motor (motor mechanism) 16 that activates the compression mechanism 14 via a crank shaft 15.

The compression mechanism 14 is composed of a first cylinder 12*c* that constitutes the first compression section 12 and a second cylinder 13*c* that constitutes the second compression section 13 arranged in two stages along the axial direction of the crank shaft 15. Cylinder chambers of the upper first cylinder 12*c* and the lower second cylinder 13*c* are separated by an intermediate partition plate 17.

The first cylinder 12*c* is set to have the height, inner diameter and capacity which are the same as those of the second cylinder 13*c*. The crank shaft 15 is rotatably supported by a primary bearing 18 and an auxiliary bearing 19. Eccentric portions 15*x* and 15*y* displaced at a phase of 180° are provided at positions corresponding to the first and the second cylinders 12*c* and 13*c*, respectively.

A first roller 12*r* fit with the eccentric portion 15*x* of the crank shaft 15 is stored in the cylinder chamber of the first cylinder 12*c*. A second roller 13*r* fitted to the eccentric portion 15*y* is rotatably stored in the second cylinder 13*c*. Each cylinder chamber of the first and the second cylinders 12*c* and 13*c* is separated into a low pressure chamber and a high pressure chamber by a first blade 12*b* and a second blade 13*b*, respectively. Each outer peripheral wall of the first and the second rollers 12*r* and 13*r* partially abuts against the peripheral wall of the cylinder chamber accompanied with the eccentric rotation via the hydraulic film seal.

Only the second cylinder 13*c* of the second compression section 13 is provided with a capacity regulating mechanism 20 which causes the second roller 13*r* to idle.

Figure 3:
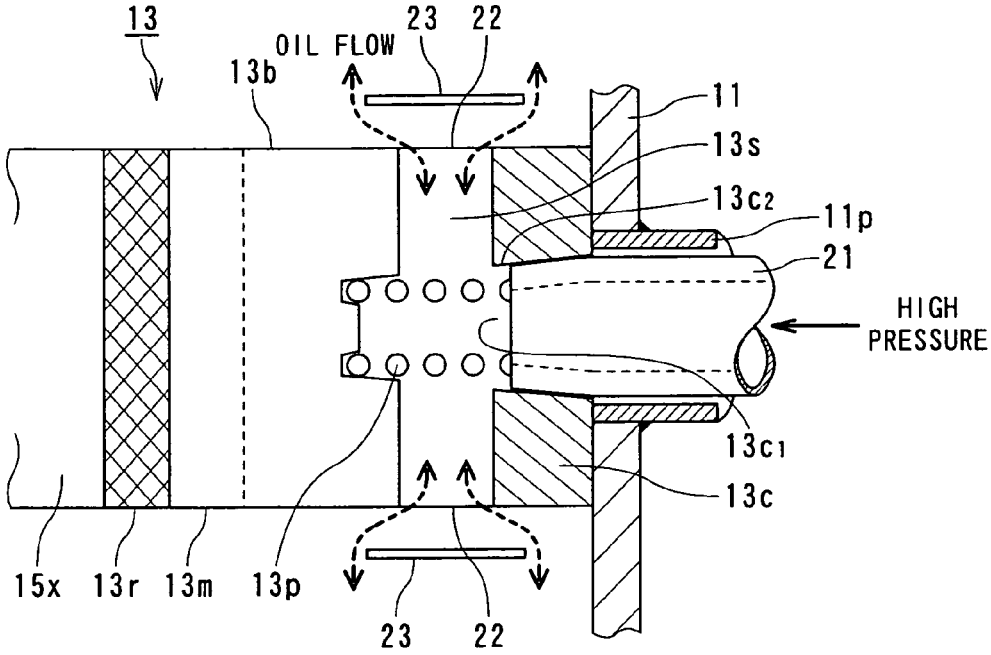
FIG. 3 is a sectional view showing the back-pressure chamber of the capacity regulating mechanism operated at the rear portion of the compression mechanism of the refrigeration cycle system (during full capacity operation) according to the present invention.
Figure 4:
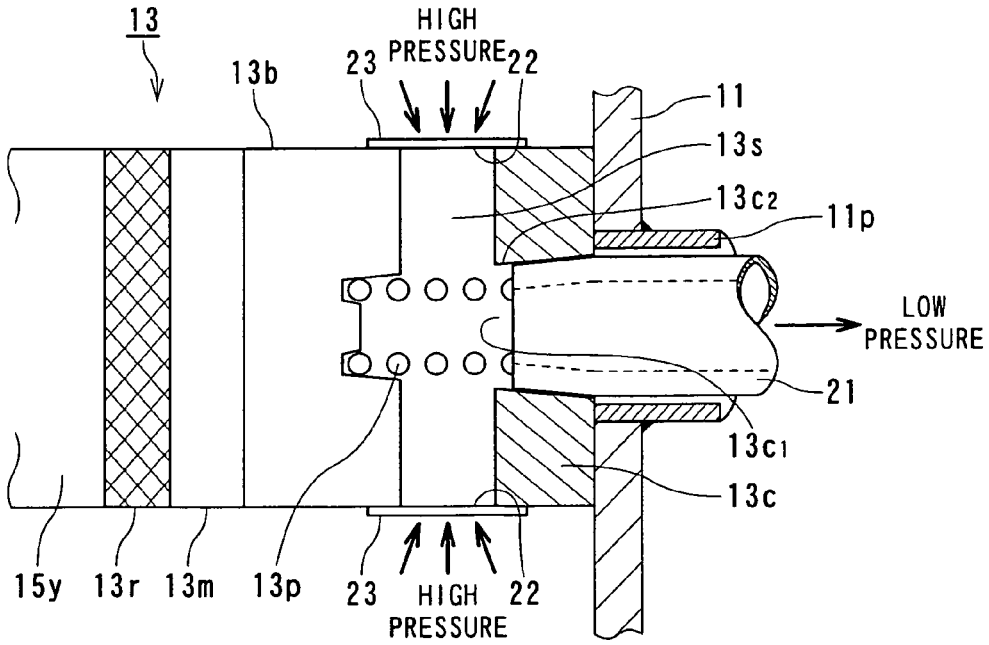
FIG. 4 is a sectional view showing the back-pressure chamber of the capacity regulation mechanism used for the refrigeration cycle system (during capacity regulation operation) according to the present invention.

Referring to FIGS. 3 and 4, the capacity regulating mechanism 20 includes a spring 13*p* stored in a back-pressure chamber 13*s* formed in the blade groove 13*m* of the second cylinder 13*c* at the side of the back surface of the blade 13*b* for pressing the back surface of the second blade 13*b*, a pressure inlet pipe 21 that pierces through the sealed case 11 having one end communicated with a pressure inlet 13*c*1 formed in the back-pressure chamber 13*s*, a pair of communication holes 22 formed in the second cylinder 13*c* so as to communicate the back-pressure chamber 13*s* and the inner space of the high pressure sealed case 11, valve bodies 23 for opening and closing the communication holes 22, and a pressure regulating four-way valve 24 communicated to the other end of the pressure inlet pipe 21.

The steel sealed case 11 is assembled with a guide pipe 11*b* formed as a copper pipe, and each gap between the guide pipe 11*p* and the tapered pressure inlet pipe 21 press fitted into the tapered hole 13*c*2 formed in the cylinder 13*c* is brazed such that the pressure inlet pipe 21 is fitted with the pressure inlet 13*c*1.

Further, the valve body 23 is set to be normally opened when the high pressure within the sealed case 11 and the high pressure within the back-pressure chamber 13*s* are applied to the pressure receiving surfaces. The valve body 23 may be a lead valve, a free valve or other type of valve.

Referring to FIGS. 1 and 2, the pressure regulating four-way valve 24 of slide type is provided with a high pressure port 24H communicated with the high pressure side of the refrigeration cycle including the inner space of the sealed case 11 through a high pressure communication pipe 25, a low pressure port 24L communicated with the low pressure side of the refrigeration cycle, that is, the accumulator 7 through a low pressure communication pipe 26, a first guide port 24*a* communicated with the back-pressure chamber 13*s* of the second cylinder 13*c* through the pressure inlet pipe 21, and a second guide port 24*b* communicated with the cylinder chamber of the second cylinder 13*c* through a suction pipe 27. During the normal operation, the high pressure port 24H and the first guide port 24*a* are communicated to establish the communication between the back-pressure chamber 13*s* and the high pressure side of the refrigeration cycle through the pressure inlet pipe 21 and the high pressure communication pipe 25. The low pressure port 24L and the second guide port 24*b* are also communicated to establish the communication between the cylinder chamber of the second cylinder 13*c* and the accumulator 7 through the suction pipe 27 and the low pressure communication pipe 26. During the uncompressed (regulated) operation, the slider 24*s* is operated to communicate the high pressure port 24H and the second guide port 24*b* so as to establish the communication between the cylinder chamber of the second cylinder 13*c* and the high pressure side of the refrigeration cycle through the suction pipe 27 and the high pressure communication pipe 25. The first guide port 24*a* and the low pressure port 24L are also communicated to establish the communication between the back-pressure chamber 13*s* and the accumulator 7. The structure for leading the high pressure to the back-pressure chamber may be realized by the use of the pressure regulating four-way valve that serves to lead the high pressure from the pressure inlet pipe. However, such structure may be realized by the use of only the low pressure inlet pipe which is closed upon switching from the uncompressed operation to the normal operation to allow the high pressure refrigerant to flow into the back-pressure chamber through the gap between the valve body 23 and the communication hole 22, and the gap between the blade groove and the blade such that the pressure is gradually increased to the high level.

Figure 5:
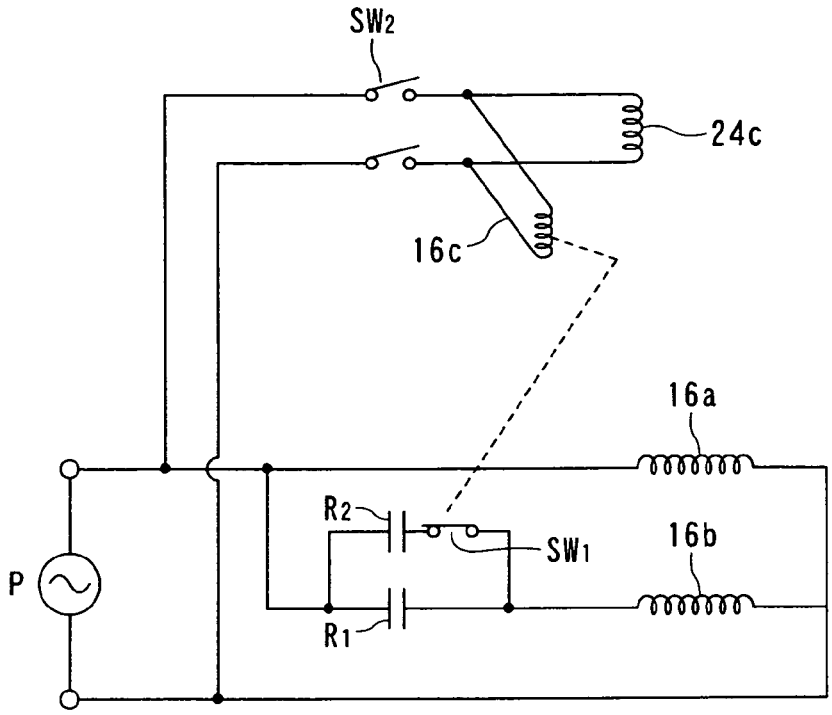
FIG. 5 is a circuit diagram of a power source employed for the refrigeration cycle system according to the present invention.

The electric motor 16 as a single-phase induction motor driven at the frequency of a commercial power source serves to switch the capacity of the capacitor between the normal operation mode and the uncompressed operation mode. Referring to FIG. 5, an auxiliary winding 16*b* is connected in parallel with a primary winding 16*a* connected to the commercial power source P. A capacitor R1 is connected to the auxiliary winding 16*b* in series. Further, a capacitor R2 and a capacitor switch SW1 connected in series are connected to the capacitor R1 in parallel. The capacity of the capacitor when the SW1 is closed becomes R1+R2, and the capacity thereof when the SW1 is opened becomes R1.

Figure 9:
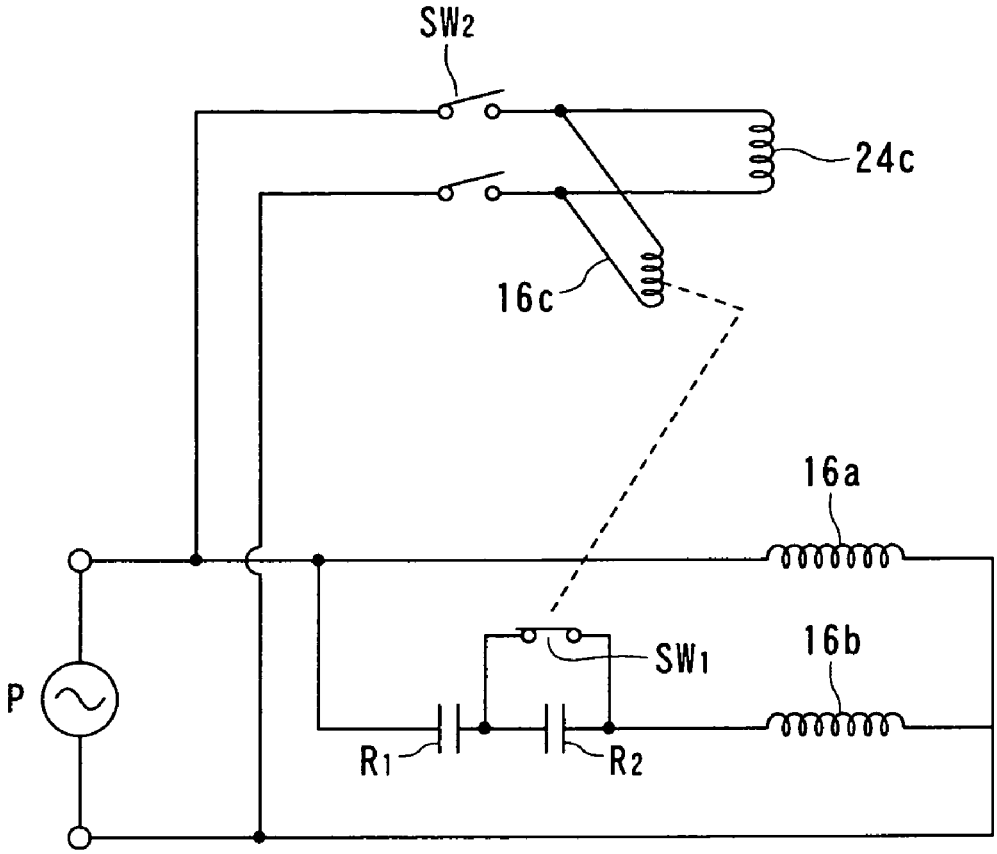
FIG. 9 is another power source circuit diagram used for the refrigeration cycle system according to the present invention.

The capacitors R1 and R2 may be connected in series, and further, the capacitor switch SW1 may be connected in parallel with the capacitor R2 as shown in FIG. 9. In this case, the capacity of the capacitor when the SW1 is closed becomes R1·R2/(R1+R2).

The capacitor switch SW1 is operated by a switching coil 16*c* which is connected to the commercial power source P in parallel with a four-way valve switching coil 24*c* for operating the slider 24*s* shown in FIG. 2 through the pressure regulating four-way valve switch SW2.

Figure 6:
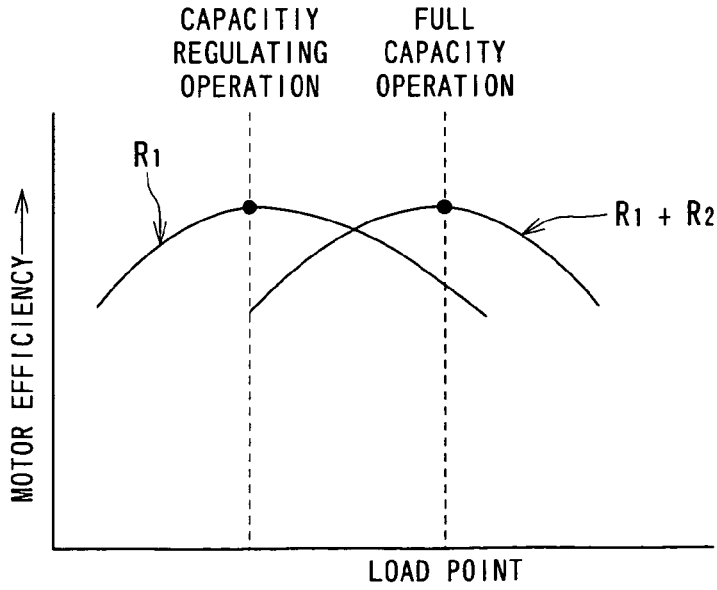
FIG. 6 is a view showing a correlation among the efficiency of a single-phase induction electric motor, a load and a capacitor capacity for the power supply circuit diagram of the refrigeration cycle system according to the present invention.
Figure 7:
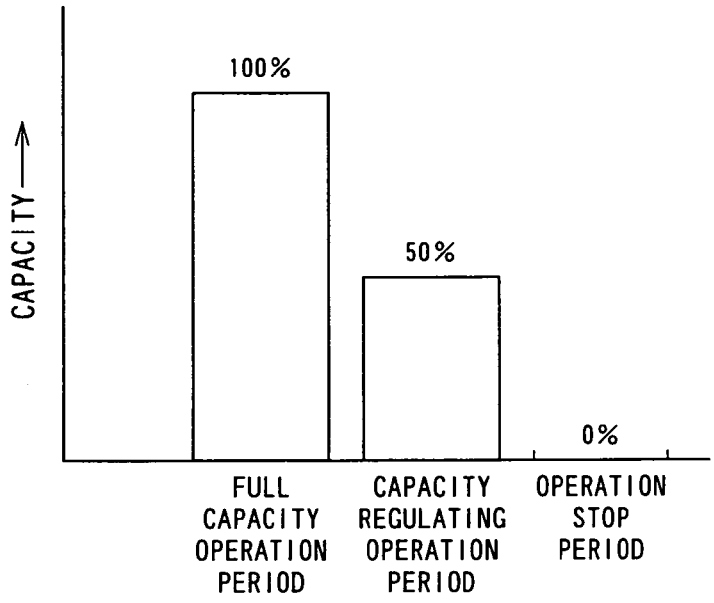
FIG. 7 is a view showing the capacity regulated state of the refrigeration cycle system of the present invention.

The single-phase induction motor exhibits a single maximum efficient point and has its feature variable depending on the capacity of the capacitor to be connected. During the full capacity operation, the capacitor switch SW1 shown in FIG. 5 is closed to connect the capacitors R1 and R2 in parallel for the purpose of increasing the capacity. Meanwhile, during the capacity regulated operation, the capacitor switch SW1 is opened to use the capacity of the capacitor R1 only. In this way, the electric motor 16 may be operated at the maximum efficient point both in the full capacity operation and the capacity regulated operation as shown in FIG. 6. This makes it possible to operate the refrigerating cycle system 1 with the high efficiency.

The operation of the refrigeration cycle system according to the first embodiment of the present invention will be described hereunder.

During the full capacity operation (operating both compression sections), the first compression section 12 with no regulating mechanism is subjected to the normal compression work. The second compression section 13 with the regulating mechanism 20 is also subjected to the normal compression work. With reference to FIG. 3, in the normal compression work to the second compression section 13, the back-pressure chamber 13*s* and the high pressure side of the refrigeration cycle are communicated via the pressure regulating four-way valve 24 shown in FIG. 2 to introduce the high pressure into the back-pressure chamber 13*s* of the second blade 13*b*. The cylinder chamber of the second cylinder 13*c* and the accumulator 7 are communicated to press the second blade 13*b* with the spring 13*p* with high pressure. The second blade 13*b* and the second roller 13*r* serve to separate the cylinder chamber of the second cylinder 13*c*. At this time, the valve bodies 23 are opened so as to establish the communication between the inner space of the high pressure sealed case 11 and the back-pressure chamber 13*s* via the communication holes 22.

During the normal operation, the second blade 13*b* follows the second roller 13*r* to perform the compression by drawing the low pressure refrigerant into the cylinder chamber of the second cylinder 13*c* from the accumulator 7. The lubricant within the back-pressure chamber 13*s* of the second blade 13*b* flows into or from the back-pressure chamber 13*s* accompanied with the movement of the second blade 13*b*. As mentioned above, since the valve bodies 23 are provided around the communication holes 22 serving as longitudinal holes for broaching the blade groove 13*m* such that the valve bodies 23 and the communication holes 22 are installed while being held apart at an arbitrary interval, the lubricant flow is not interrupted. The lubricant is not subjected to the compression, thus saving the energy during the full capacity operation.

During the capacity regulated operation (operating single compression section), the back-pressure chamber 13*s* and the accumulator 7 are communicated via the pressure regulating four-way valve 24 so as to draw the suction pressure to the back surface of the second blade 13*b* and to establish the communication between the cylinder chamber of the second cylinder 13*c* and the high pressure side of the refrigeration cycle as shown in FIGS. 1 and 4. The difference in pressures between the back-pressure chamber 13*s* at the low pressure and the inner space of the sealed case 11 at the high pressure causes the valve bodies 23 to close the communication holes 22 so as to completely interrupt the communication between the back-pressure chamber 13*s* and the inner space of the high pressure sealed case 11.

In the state described above, the pressure in the back-pressure chamber 13*s* becomes low, and the suction pressure is applied to the back surface of the second blade 13*b*. The high pressure in the cylinder chamber of the second cylinder 13*c* is applied to the leading end of the second blade 13*b*. The resultant difference in pressures between the leading end and the back surface of the second blade 13*b* makes it sure to be retracted toward the back-pressure chamber 13*s* irrespective of the spring 13*p*. The second blade 13*b* does not abut against the second roller 13*r* that makes the eccentric rotation. The cylinder chamber of the second cylinder 13*c* is not divided into the low pressure chamber and the high pressure chamber. Then the second roller 13*r* idles, and no compression is performed in the second compression portion 13. Thus, the compressor 2 performs the compression work with its capacity 50% of the full compression capacity.

There is no need of reducing the spring constant of the spring 13*p* pressing the second blade 13*b* against the second roller 13*r* for the purpose of moving the second blade 13*b* away from the second roller 13*r* by utilizing the large pressure difference during the uncompressed operation. During the normal operation, the spring 13*p* serves to press the second blade 13*b* of the back-pressure chamber 13*s* at the high pressure. This pressing may prevent jumping of the second blade 13*b*, thus generating no noise or damage thereto. Furthermore, since the second blade 13*b* may be retracted into the second blade groove 13*m* and held therein during the uncompressed operation, the jumping of the second blade 13*b* can be prevented from causing.

Figure 8:
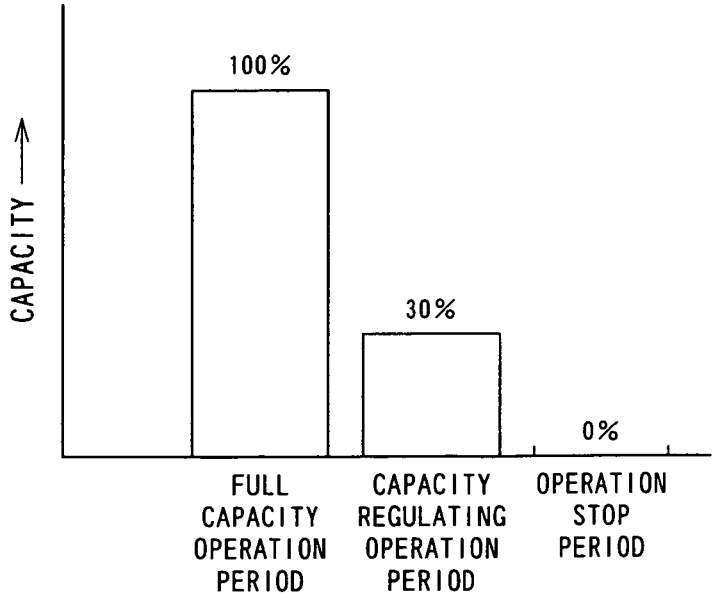
FIG. 8 is a view showing the capacity regulated state of the refrigeration cycle system of another embodiment of the present invention.

The compression capacity may be adjusted by changing the ratio of capacities between the second cylinder 13*c* and the first cylinder 12*c*. If the capacity ratio is set to 7:3, for example, the capacity regulated operation becomes 30% of the full compression capacity as shown in FIG. 8.

The refrigeration cycle system according to the described embodiment may employ the capacity regulation mechanism which operates the slider of the pressure regulating four-way valve for making the capacity of the compressor variable without using the complicated electronic circuit such as inverter.

The use of the capacity variable mechanism, which can be manufactured at low cost and hardly causes the failure, does not deteriorate the performance of the refrigeration cycle system. During the normal operation, the blade is pressed by the spring at the high pressure to prevent the blade from jumping, thus generating no noise and no damage to the blade. During the capacity regulated operation, the blade may be reliably held within the cylinder blade groove. The use of the commercial compressor operated at 50 to 60 rps immediately after the start-up may also prevent the blade form jumping, thus avoiding generation of abnormal noise. The capacity regulating mechanism may be actuated during the operation so as to obtain the comfort and energy saving effect. The valve body serves to interrupt the communication between the inner space of the sealed case and the back-pressure chamber. Since the high pressure refrigerant in the sealed case does not leak into the suction side, the leakage loss in the capacity regulating mechanism may be controlled to zero.

INDUSTRIAL APPLICABILITY

According to the present invention, one compression section of the two-cylinder type rotary compression mechanism is provided with a capacity regulating mechanism which performs the uncompressed operation in the low load state for realizing the low performance operation. This makes it possible to suppress the generation of noise and to prevent the blade from being damaged, thus allowing the uncompressed operation to be performed continuously. The refrigerating cycle system provided with the aforementioned compression mechanism may be applied in various forms in the industrial fields.

The invention claimed is:

1. A refrigeration cycle system provided with a rotary compressor including a sealed case, an electric motor disposed in the sealed case and a compression mechanism disposed in the sealed case and connected to the electric motor, wherein the compression mechanism is provided with a first compression section and a second compression section, each compression section having a cylinder and a cylinder chamber in which rollers are held to be eccentrically rotatable, respectively, and also provided with blades disposed in the first and the second cylinders each blade having a leading end urged by a spring member so as to abut against a curved surface of the roller and serving to separate the cylinder chamber into two sections along a rotating direction of the roller, one of the first and the second compression sections is provided with a capacity regulating mechanism including a switching member which serves to switch and guide low-pressure refrigerant or high pressure refrigerant of the refrigeration cycle to a back-pressure chamber formed to a back surface side of the blade, to guide the high-pressure refrigerant into the cylinder chamber when the low-pressure refrigerant is guided into the back-pressure chamber and to guide the low-pressure refrigerant into the cylinder chamber when the high-pressure refrigerant is guided into the back-pressure chamber, and wherein the switching member is switched so as to guide the high-pressure refrigerant into the back-pressure chamber of one of the compression sections in a high load state and guide the low-pressure refrigerant into the cylinder chamber so as to perform a normal operation by pushing the blade against the roller by pressure difference between pressure of the high-pressure refrigerant guided into the back-pressure chamber and pressure of the low-pressure refrigerant guided into the cylinder chamber, and on the other hand, the switching member is switched so as to guide the low-pressure refrigerant into the back-pressure chamber of one of the compression sections in a low load state and guide the high-pressure refrigerant into the cylinder chamber so as to perform an uncompressed operation by separating the blade from the roller by pressure difference between pressure of the low-pressure refrigerant guided into the back-pressure chamber and pressure of the high-pressure refrigerant guided into the cylinder chamber; and wherein the one compression section with the capacity regulating mechanism includes the back-pressure chamber at the back surface side of the blade, which is opened and closed by a pressure difference between a pressure in the back-pressure chamber and a pressure in an inner space of the sealed case acting on a valve body, the valve body is closed to seal the back-pressure chamber upon introduction of the low pressure refrigerant to the back-pressure chamber through a pressure introduction hole communicated with the back-pressure chamber and formed for introducing the low pressure refrigerant, and the valve body is opened upon introduction of the high pressure refrigerant to establish a communication between the back-pressure chamber and the inner space of the sealed case through a communication hole formed in one of the compression sections, and the communication introduces a lubricating oil from the inner space of the sealed case into the back pressure chamber.

2. A refrigeration cycle system according to claim 1, wherein the capacity regulating mechanism further comprises a capacity variable four-way switching valve provided with a high pressure port connected to a high pressure side of the refrigeration cycle, a low pressure port connected to a low pressure side of the refrigeration cycle, a first guide port connected to the back surface side of the blade in one of the compression sections, and a second guide port connected to a cylinder chamber of the one compression section, and wherein during the normal operation, communications are established between the high pressure port and the first guide port and between the low pressure port and the second guide port, and during the uncompressed operation, communications are established between the high pressure port and the second guide port and between the low pressure port and the first guide port.

3. A refrigeration cycle system according to claim 1, wherein the electric motor is a single-phase driven at a frequency of a commercial power source, the motor being connected to a capacitor, and wherein a capacitor switch is used to vary the capacitance of the capacitor in order for the compressor to be operated between the normal operation and the uncompressed operation.

4. A refrigeration cycle system according to claim 1, wherein, in the normal operation, generation of noise from jumping of the blade is avoided.

5. A refrigeration cycle system according to claim 1, wherein, as a result of application of pressure differentials, damage to the blades is avoided.

6. A refrigeration cycle system according to claim 5, wherein, in the normal operation, generation of noise from jumping of the blade is avoided.

7. A refrigeration cycle system provided with a rotary compressor including a sealed case, an electric motor disposed in the sealed case and a compression mechanism disposed in the sealed case and connected to the electric motor, wherein the compression mechanism is provided with a first compression section and a second compression section, each including a first cylinder and a second cylinder having cylinder chambers in which rollers are held to be eccentrically rotatable, respectively, and also provided with blades disposed in the first and the second cylinders each blade having a leading end urged by a spring member so as to abut against a curved surface of the roller and serving to separate the cylinder chamber into two sections along a rotating direction of the roller, one of the first and the second compression sections is provided with a capacity regulating mechanism including a switching member which switches a back surface side of the blade between a low pressure mode and a high pressure mode and serves to communicate an inner space of the cylinder chamber with the high pressure upon switching of the back surface side of the blade at the low pressure mode, the capacity regulating mechanism including a capacity variable four-way switching valve provided with a high pressure port connected to a high pressure side of the refrigeration cycle, a low pressure port connected to a low pressure side of the refrigeration cycle, a first guide port connected to the back surface side of the blade in one of the compression sections, and a second guide port connected to a cylinder chamber of one of the compression sections, and at a time of large load, a normal operation is performed by establishing communications between the high pressure port and the first guide port and between the low pressure port and the second guide port to thereby switch the back surface side of the blade of the one of the compression sections to the high pressure mode, and at a time of small load, an uncompressed operation is performed by establishing communications between the high pressure port and the second guide port and between the low pressure port and the first guide port to thereby switch the back surface side of the blade on the one of the compression sections to the low pressure mode and the inside of the cylinder chamber to the high pressure mode so as to move the blade apart from the roller to perform the uncompressed operation; and the one compression section provided with the capacity regulating mechanism includes a back-pressure chamber at the back surface side of the blade, which is opened and closed by a pressure difference between a pressure in the back-pressure chamber and a pressure in an inner space of the sealed case acting on a valve body, the valve body is closed to seal the back-pressure chamber upon introduction of a low pressure refrigerant into the back-pressure chamber through a pressure introduction hole communicated with the back-pressure chamber and formed for introducing the low pressure refrigerant, and the valve body is opened upon introduction of a high pressure refrigerant to establish a communication between the back-pressure chamber and the inner space of the sealed case through a communication hole formed in one of the compression sections, and the communication introduces a lubricating oil from the inner space of the sealed case into the back pressure chamber.

8. A refrigeration cycle system according to claim 7, wherein the electric motor is a single-phase driven at a frequency of a commercial power source, the motor being connected to a capacitor, and wherein a capacitor switch is used to vary the capacitance of the capacitor in order for the compressor to be operated between the normal operation and the uncompressed operation.

9. A refrigeration cycle system according to claim 7, wherein, in the normal operation, generation of noise from jumping of the blade is avoided.

10. A refrigeration cycle system according to claim 7, wherein, as a result of application of pressure differentials, damage to the blades is avoided.

11. A refrigeration cycle system according to claim 10, wherein, as a result of application of pressure differentials in the normal operation, generation of noise from jumping of the blade is avoided.

12. A refrigeration cycle system provided with a rotary compressor including a sealed case, an electric motor disposed in the sealed case and a compression mechanism disposed in the sealed case and connected to the electric motor;

wherein the compression mechanism is provided with a first compression section and a second compression section, each compression section having a cylinder and a cylinder chamber in which rollers are held to be eccentrically rotatable, respectively, and also provided with blades disposed in the first and the second cylinders each blade having a leading end so as to abut against a curved surface of the roller and serving to separate the cylinder chamber into two sections along a rotating direction of the roller;

one of the first and the second compression sections is provided with a capacity regulating mechanism including a switching member which serves to switch and guide low-pressure refrigerant or high pressure refrigerant of a refrigeration cycle to a back-pressure chamber formed to a back surface side of the blade;

the switching member is switched so as to guide the high-pressure refrigerant into the back-pressure chamber of one of the compression sections in a high load state so as to perform a normal operation by pushing the blade against the roller, and on the other hand, the switching member is switched so as to guide the low-pressure refrigerant into the back-pressure chamber of one of the compression sections in a low load state so as to perform an uncompressed operation by separating the blade from the roller;

wherein the back-pressure chamber is opened and closed by a pressure difference between a pressure in the back-pressure chamber and a pressure in an inner space of the sealed case acting on a valve body, the valve body is closed to seal the back-pressure chamber upon introduction of the low pressure refrigerant into the back-pressure chamber through a pressure introduction hole communicated with the back-pressure chamber and formed for introducing the low pressure refrigerant, and the valve body is opened upon introduction of the high pressure refrigerant to establish a communication between the back-pressure chamber and the inner space of the sealed case through a communication hole formed in one of the compression sections, and the communication introduces a lubricating oil from the inner space of the sealed case into the back pressure chamber.

* * * * *